United States Patent [19]

Peng

[11] Patent Number: 4,821,651

[45] Date of Patent: Apr. 18, 1989

[54] TABLE WITH CHANGEABLE TABLE SHEET

[76] Inventor: Jung-Chang Peng, No. 773-10, Chung Shan Rd., Wu-Jih Hsiang Taichung, Taiwan

[21] Appl. No.: 58,757

[22] Filed: Jun. 5, 1987

[51] Int. Cl.[4] ..... A47B 3/06

[52] U.S. Cl. ..... 108/157; 108/153

[58] Field of Search ..... 108/157, 153, 154, 27, 108/96, 64, 136, 37, 90; 211/59.3; 221/45, 58, 59

[56] References Cited

U.S. PATENT DOCUMENTS

| | | | |
|---|---|---|---|
| 735,312 | 8/1903 | Stokes | 108/96 |
| 1,916,435 | 7/1933 | Ott et al. | 108/157 |
| 2,013,135 | 9/1935 | Corduan | 108/153 |
| 2,644,733 | 7/1953 | Castle | 108/157 |
| 2,863,675 | 12/1958 | Otto | 221/45 |
| 3,236,412 | 2/1966 | Vaught et al. | 108/136 X |
| 3,291,339 | 12/1966 | Hein | 221/45 |
| 3,659,535 | 5/1972 | Gerney et al. | 108/136 |
| 4,386,995 | 6/1983 | King | 221/45 X |
| 4,413,570 | 11/1983 | Haigh | 108/153 |
| 4,416,392 | 11/1983 | Smith | 221/45 |
| 4,444,125 | 4/1984 | Welsch | 108/153 X |
| 4,563,040 | 1/1986 | Alster | 108/153 X |
| 4,627,363 | 12/1986 | Jones | 108/90 |
| 4,677,920 | 7/1987 | Eccardt | 108/64 X |

FOREIGN PATENT DOCUMENTS

| | | | |
|---|---|---|---|
| 1910867 | 10/1969 | Fed. Rep. of Germany | 108/157 |
| 1357160 | 2/1964 | France | 211/593 |

*Primary Examiner*—Kenneth J. Dorner
*Assistant Examiner*—José V. Chen
*Attorney, Agent, or Firm*—Browdy & Neimark

[57] ABSTRACT

A table with changeable table sheet consisting of a base and a plurality of edge members inserted onto the upper surface of the base. All the edge members merge into one another at respective margins to form a retaining seat. A supporting board and a table sheet are movably positioned into the retaining seat respectively and engaged by the edge members. The table sheet is formed by a plurality of separated layers of soft membranes. A plurality of spring members are disposed about the retaining seat between the supporting board and the base. A plurality of legs are connected onto the undersurface of the base to stably support the retaining seat.

7 Claims, 2 Drawing Sheets

TABLE WITH CHANGEABLE TABLE SHEET

BACKGROUND OF THE INVENTION

The present invention relates to a table, and more particularly to a table with changeable table sheet.

After being used for a period of time, the table surface of conventional tables will be damaged and/or become dirty, affecting not only the sanitary purpose but also its outer appearance.

A tablecloth can certainly overcome the above shortcoming but it has to be washed frequently since it becomes dirty easily after being used.

SUMMARY OF THE INVENTION

The main object of the present invention is to provide a table with a changeable table sheet which can keep it in a good and condition and a satisfactory outer appearance.

Another object of the present invention is to provide a table with a changeable table sheet capable of being handled simply and quickly.

Another object of the present invention is to provide a table with changeable table sheet capable of packing up the waste on the table.

A table according to the present invention comprises a base; a plurality of edge members inserted onto the upper surface of said base, each edge member having a first plate and a second plate extending laterally from the upper edge of said first plate, all edge members merging into one another at respective margins to form a retaining seat; a supporting board and a table sheet movably positioned into the retaining seat respectively and engaged by said edge members, said table sheet being formed by a plurality of separated layers of soft membranes; a plurality of spring members disposed between the supporting board and the base; a plurality of legs connected to the undersurface of said base to support the retaining seat stably.

DETAILED DESCRIPTION OF THE PREFERRED EMBODIMENT

Figure 1:
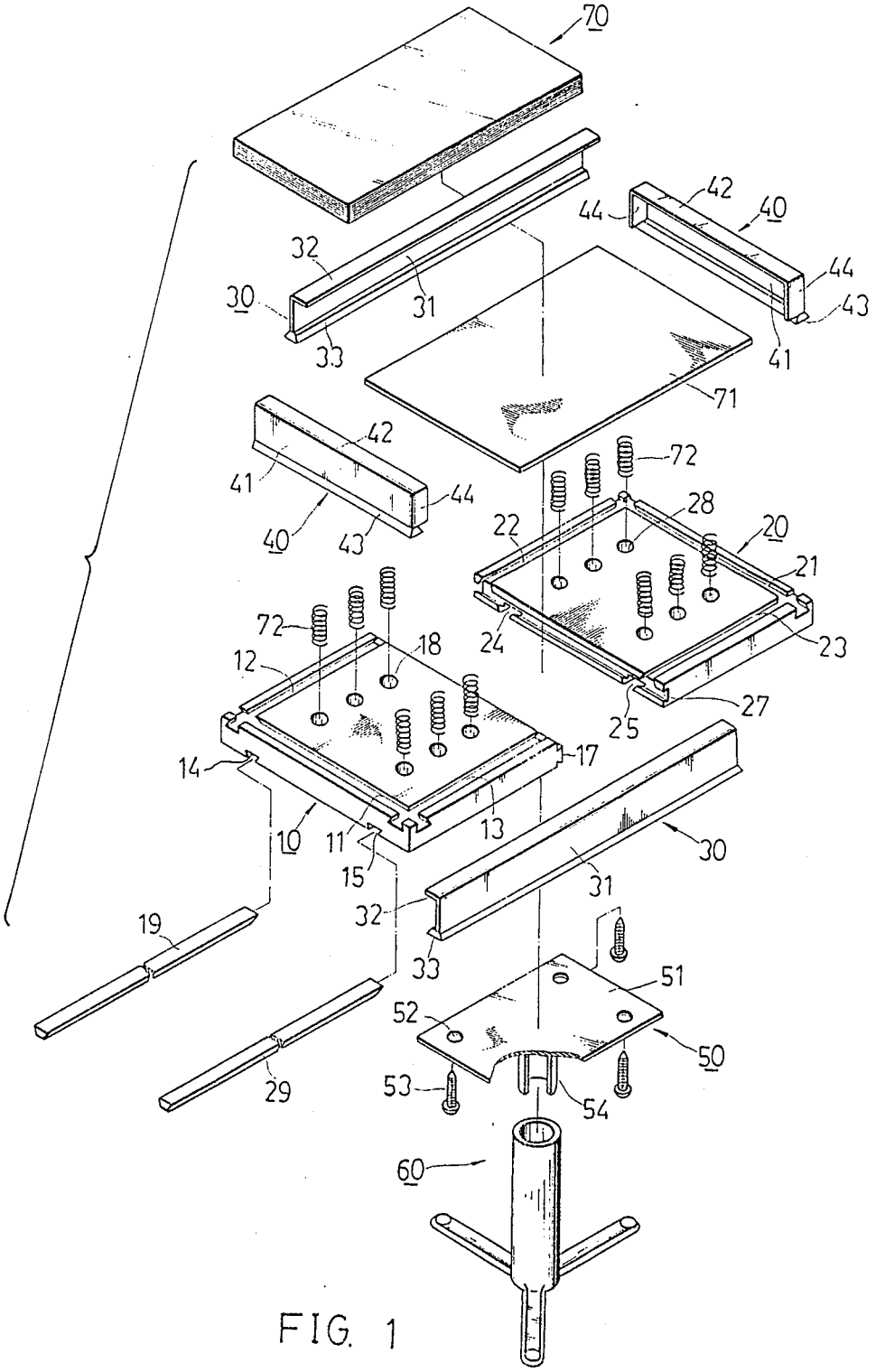
FIG. 1 is an exploded view of a table in accordance with one preferred embodiment of the present invention.
Figure 2:
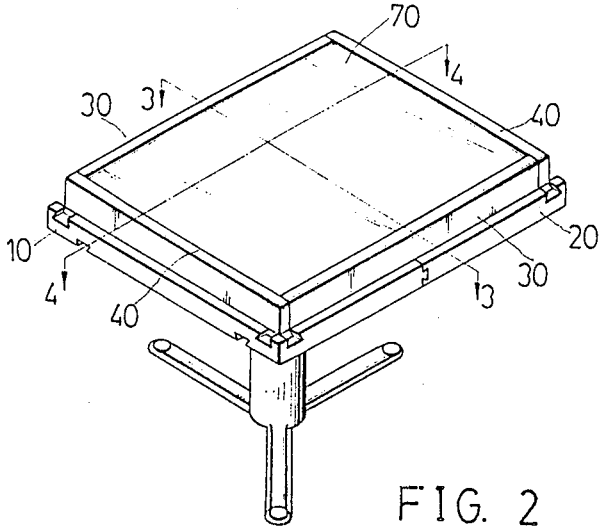
FIG. 2 is a perspective view of an assembled table from FIG. 1.
Figure 3:
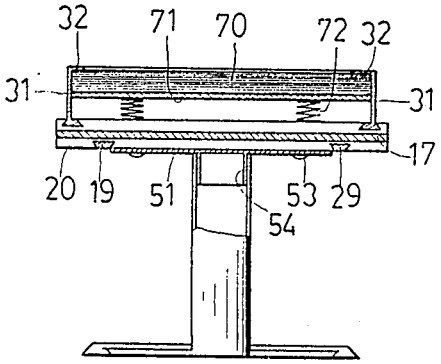
FIG. 3 is a cross-sectional view taken along line 3—3 of FIG. 2.
Figure 4:
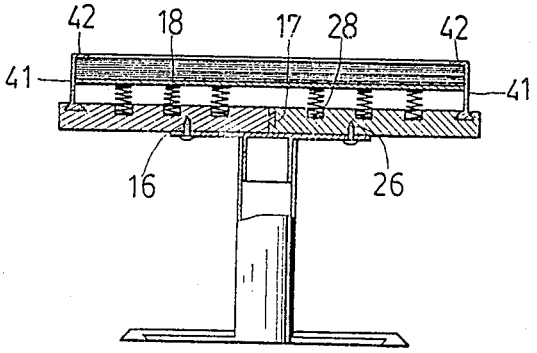
FIG. 4 is a cross-sectional view taken along line 4—4 of FIG. 2.

Referring in detail to the drawings and particularly to FIG. 1, after the engagement between bottom boards 10, 20 which is reinforced by two pieces of joint members 19, 29, four pieces of edge members 30, 40 are inserted onto the bottom boards 10, 20 to form a retaining seat. A connective member 50 is connected onto the undersurface of bottom boards 10, 20 and sleeved into a leg 60. A plurality of spring members 72, a supporting board 71 and a table sheet 70 are positioned into the retaining seat respectively to form a complete table.

Left bottom board 10 has three dovetailed grooves 11, 12, 13 provided along three edges of the upper surface thereof its in longitudinal and transverse direction while two dovetail grooves 14, 15 are provided on the undersurface thereof in the transverse direction. Two screw holes 16 are provided near the right side of left bottom board 10 and a dovetailed convexity 17 extends longitudinally from the right side of said left bottom board 10. A plurality of recesses 18 are provided on the upper surface of said left bottom board 10 and surrounded by said grooves 11, 12, 13.

A right bottom board 20 has a plurality of dovetailed grooves 21–25, screw holes 26, and recesses 28 positioned symmetrically and/or alignment with left bottom board 10. A dovetailed groove 27 is provided on the left side of said right bottom board 20 to insert therein the convexity 17 of said left bottom board 10. Two joint members 19 and 29 are inserted respectively into the dovetailed grooves 14, 24 and 15, 25 to reinforce the engagement between the bottom boards to constitute a complete base therefor.

A pair of transverse edge members 30 are fixed onto the base. Each transverse edge member 30 includes a first plate 31 in rectangular shape, a second plate 32 extending laterally from the upper edge of the first plate 31 and a convexity 33 situated on the under edge of the first plate 31.

A pair of longitudinal edge members 40 are fixed onto the base. Each longitudinal edge member 40 includes a first plate 41 in rectangular shape, a second plate 42 extending laterally from the upper edge of the first plate 31, a convexity 43 situated on the under edge of the first plate 41, and two side walls 44 transversely extending along two opposite side edges of the first plate 41 and contacting with two ends of the second plate 42 respectively.

While the convexities 33, 43 of the edge members 30, 40 are inserted into the grooves 12, 22, 13, 23 and 11, 21, all edge members 30, 40 merge into one another at respective margins thereof to form a retaining seat.

The connective member 50 includes a fixing plate 51 having screw holes 52 and a cylinder portion 54 extending downwardly therefrom. The fixing plate 51 is screwed into the bottom boards 10, 20 by four screws 53 through the screw holes 52, 16 and the cylinder portion 54 is sleeved into a leg 60 to support the retaining seat stably.

The table sheet 70 formed by separated layers of geotextile membranes or paper sheets or PVC membranes or other soft membranes is movably positioned into said retaining seat. The supporting board 71 having a size the same as that of the table sheet 70 and positioned thereunder. The spring members 72 are received in the recesses 18, 28 and between the supporting board 71 and the base of the retaining seat. The supporting board 71 is pressed by the spring members to urge against the second plates 32, 42 of the edge members 30, 40.

When the table is in use, the supporting board 71 is pressed upwardly by the spring members 72 to support the weight on the table sheet.

When the table sheet 70 is dirty or broken, if a hand force to press the table sheet 70 downwardly is exercised thus causing spring members 72 to be deformed downwardly, the table sheet 70 will be separated from the second plates 32, 42 of the edge members 30, 40, and one layer of the table sheet 70, can be detached from the table, and sheet can be used to pack up the waste thereon. After the hand force on the table has been released, the spring members 72 will press the table sheet 70 to the original or topmost position with a fresh table sheet layer on the table surface.

What is claimed is:

1. A table with a changeable table sheet comprising:

a base;

a plurality of edge members inserted onto an upper surface of said base, each edge member having a vertical first plate and a second plate extending substantially perpendicularly from an upper side of said first plate, and all edge members merging into one another at respective ends to form a retaining seat;

a table sheet formed by a plurality of separable layers of soft membranes movably positioned on the retaining seat and engaged by the second plates of each edge member;

a supporting board having a size generally equal to the size of the table sheet and positioned thereunder;

a plurality of spring members disposed on the retaining seat between said supporting board and said base;

a plurality of legs connected onto an undersurface of said base to stably support the retaining seat; and a pair of longitudinal grooves and a pair of transverse grooves provided on the upper surface of the base, the first plate of each edge member having a rectangular shape, and each edge member further having a convexity situated on an underside of the first plate adapted to be inserted into one of the longitudinal and transverse grooves, respectively.

2. A table as in claim 1, wherein said base comprises a rectangular left bottom board and a right bottom board being substantially equal in size, a convexity extending longitudinally from the right side of said left bottom board, and a groove provided on the left side of said right bottom board adapted to be inserted into the convexity of said left bottom board.

3. A table in claim 2, further comprising at least two transverse grooves provided on the undersurface of each of the left and right bottom boards, the grooves on the left bottom board being aligned with the grooves on the right bottom board, and joint members receivable in said two transverse grooves to reinforce the engagement between said left and right bottom boards.

4. A table as in claim 1, wherein a plurality of recesses are provided on the upper surface of said base for receiving a plurality of spring members.

5. A table as in claim 1, wherein said table sheet comprises a plurality of geotextile membranes.

6. A table as in claim 1, wherein said table sheet comprises a plurality of paper sheets.

7. A table as in claim 1, wherein said table sheet comprises a plurality of PVC membranes.

* * * * *